US006066230A

United States Patent [19]

Arai

[11] Patent Number: 6,066,230

[45] **Date of Patent: *May 23, 2000**

[54] PLANARIZATION METHOD, WORKPIECE MEASURING METHOD, AND SURFACE PLANARIZATION APPARATUS HAVING A MEASURING DEVICE

[75] Inventor: Hatsuyuki Arai, Ayase, Japan

[73] Assignee: Speedfam Co., Ltd., Ayase, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/026,706

[22] Filed: Feb. 20, 1998

[30] Foreign Application Priority Data

Feb. 20, 1997 [JP] Japan ..... 9-053930

[51] Int. Cl.[7] ..... B24B 5/00

[52] U.S. Cl. ..... 156/345; 216/88; 438/8; 438/692

[58] Field of Search ..... 156/345; 438/8, 438/690–693; 216/88, 89; 451/290–291

[56] References Cited

U.S. PATENT DOCUMENTS

| | | | |
|---|---|---|---|
| 2,238,859 | 4/1941 | Indge . | |
| 4,996,798 | 3/1991 | Moore . | |
| 5,081,796 | 1/1992 | Schultz . | |
| 5,196,353 | 3/1993 | Sandhu et al. | 437/8 |
| 5,337,015 | 8/1994 | Lustig et al. | 324/671 |
| 5,503,592 | 4/1996 | Neumann . | |
| 5,534,106 | 7/1996 | Cote et al. | 156/636.1 |
| 5,628,862 | 5/1997 | Yu et al. | 156/345 |
| 5,672,991 | 9/1997 | Thoma et al. . | |

FOREIGN PATENT DOCUMENTS

| | | |
|---|---|---|
| 0 738 561 A1 | 10/1996 | European Pat. Off. . |
| 62-188658 | 8/1987 | Japan . |
| 8-174411 | 7/1996 | Japan . |
| 8-222534 | 8/1996 | Japan . |
| 8-257894 | 10/1996 | Japan . |
| 2 301 544 | 12/1996 | United Kingdom . |

*Primary Examiner*—Bruce Breneman
*Assistant Examiner*—Alva C. Powell
*Attorney, Agent, or Firm*—Snell & Wilmer L.L.P.

[57] ABSTRACT

A [work] workpiece processing apparatus and a [work] workpiece measuring method are provided in which a [work] workpiece can be processed or planarized without decreasing a processing rate and/or an operating rate of the apparatus. The apparatus can be reduced in size, and can measure the state of planarization of the [work] workpiece at a high degree of accuracy. The apparatus includes a rotatable surface plate, and a carrier 6 for swinging or oscillating a [work] workpiece 200 in a radial direction of the surface plate 1 while pressing the [work] workpiece 200 against the surface plate 1. The surface plate 1 is divided into an inner surface plate member 11, an intermediate surface plate member 12, and an outer surface plate member 13 which are all disposed in a concentric relation and rotatable independently of each other. The intermediate surface plate member 12 is disposed between the inner and outer surface plate members 11 and 13.

5 Claims, 9 Drawing Sheets

PLANARIZATION METHOD, WORKPIECE MEASURING METHOD, AND SURFACE PLANARIZATION APPARATUS HAVING A MEASURING DEVICE

BACKGROUND OF THE INVENTION

1. Field of the Invention

The present invention relates to a surface planarization apparatus for polishing a workpiece in its pressed state by a rotating surface plate and also to a workpiece measuring method.

2. Description of the Related Art

Conventionally, a chemical and mechanical polishing (hereinafter simply referred to as CMP) apparatus has been known as such a kind of surface planarization apparatus.

FIG. 13 shows in cross section an example of a CMP apparatus. In FIG. 13, a reference symbol 100 designates a surface plate which is formed of a disk member with a polishing pad 101 made of urethane being adhered to an upper surface thereof. The surface plate 100 is mounted on an upper surface of a rotation member or rotor 100 which in turn is rotatably mounted on a central shaft 111 through a bearing 112. By energizing a drive means 130 such as a motor to rotate the rotor 110, the surface plate 100 is caused to rotate together with the rotor 110.

With this CMP apparatus, a work 200 disposed on the surface plate 100 is urged or pressed against the surface plate 100 by means of a carrier 210 so that it is driven to rotate so as to be planarized or polished by the surface plate 100 while a polishing medium such as a polishing liquid is supplied thereto.

Specifically, the workpiece 200 is pressed against the surface plate 100 through a packing pad 211 to a lower surface of which the carrier 210 is adhered. In this state, the surface plate 100 and the carrier 210 are caused to rotate in the right-hand or clockwise rotational direction at the same rotation speed. At this time, the carrier 210 is oscillated in a radial direction of the surface plate 100, as shown by an arrow A.

Furthermore,, the CMP apparatus is provided with a laser sensor 300 for measuring the state of planarization or polishing of the workpiece 200.

Specifically, a small-diameter hole 120 is formed through the polishing pad 101, the surface plate 100 and the rotor 110 with the laser sensor 300 being disposed under the hole 120.

With this arrangement, when the hole 120 comes right above the laser sensor 300 during rotation of the surface plate 100, a laser beam is issued from the laser sensor 300 toward the hole 120 to thereby measure the polishing state of the workpiece 200 over the hole 120.

However, the rotating surface plate of the above-mentioned polishing apparatus has involved the following problems.

During continued use of the polishing pad 101, the central portion of the polishing pad 101 is worn out greater than the inner and peripheral portions thereof.

That is, the polishing pad 101 has been frequently subjected to a localized or non-uniform wear, and the operation of the CMP apparatus has to be stopped every time such a localized wear takes place, so that the polishing pad 101 is dressed, cutting down the inner and outer peripheral portions up to the thickness of the central portion to thereby level the entire surface of the pad. Otherwise, the polishing pad 101 thus locally worn has to be replaced with a new one. As a consequence, it is necessary to stop the CMP apparatus for a long period of time, and hence the operating rate of the apparatus is very bad.

Moreover, since when the rotating hole 120 comes right above the laser sensor 300, it is necessary to operate the laser sensor 300, the control of timing is very difficult. Especially, since the workpiece 200 is swung or oscillated in a radial direction of the surface plate 100, the oscillating movement of the carrier 210 need be controlled to locate the central and peripheral portions of the workpiece 200 just above the hole 120 when the hole 120 comes right above the laser sensor 300. Thus, such a control is very difficult. As a consequence, the polishing state of the workpiece 200 can not be measured accurately.

Furthermore, the laser measurement has sometimes been disabled or obstructed due to the polishing liquid collected in the small hole 120. In addition, measurements are limited to only the central portion and a part of the peripheral portion of the workpiece 200.

The present invention is intended to solve the above-described various problems based on the following consideration.

The invention have noted a difference between the length of sliding contact of the polishing pad 101 with the work 200 when the workpiece 200 is located at an outermost peripheral portion of the polishing pad 101 and the length of sliding contact thereof when the workpiece 200 is located at an innermost peripheral portion of the polishing pad 101.

FIG. 14 is a schematic plan view showing an oscillating state of the workpiece 200. FIG. 15 is a comparison chart in which sliding contact lines in FIG. 14 are superposed for the purpose of comparison.

When the surface plate 100 is located at the outermost peripheral portion of the polishing pad 101 due to a swinging of oscillating motion thereof in the direction of arrow A as shown in FIG. 14, a sliding contact line 3 indicated at an alternate long and short dash line is taken, whereas when the surface plate 100 is located at the innermost peripheral portion of the polishing pad 101, a sliding contact line C indicated at a short dashes line is taken.

The length of the sliding contact line B increases from the left-hand end of the workpiece 200 to the central portion thereof and decreases from the central portion toward the right-hand end of the workpiece 200. The length of the sliding contact line C changes similarly, too.

However, as shown in FIG. 15, the lengths of the sliding contact lines B and C of the corresponding portions of the workpiece 200 vary according to the position of the work 200. For instance, when a comparison is made between a leftmost sliding contact line B' when the workpiece 200 is at an outermost peripheral position and a sliding contact line C' when the workpiece 200 is at an innermost peripheral position, the sliding contact line C' is longer than the sliding contact line B'.

In order to analyze this phenomenon, the inventors took the length of a sliding contact line as the corresponding time of sliding contact, and considered the sliding contact time at each position of the workpiece 200.

FIG. 16 schematically illustrates in a plan view the position of oscillation or swing of the workpiece 200, and FIG. 17 is a diagram illustrating the sliding contact time in which the left-hand ordinate axis indicates the sliding contact time at each position and the right-hand axis ordinate indicates the value of time at which the sliding contact times of respective positions are superposed one over another.

First of all, when a workpiece 200-1 is disposed at a location P1 in FIG. 16 (e.g., 162 mm apart from the center O of the polishing pad 101), the sliding contact time of the polishing pad 101 during which it contacts the workpiece 200-1 takes a curve S1.

That is, the sliding contact time is 0 seconds at the opposite ends of the workpiece 200-1, and it takes a maximum value of about 0.45 seconds substantially at the center of the workpiece 200-1. Subsequently, when another workpiece 200-2 is disposed at a location P2 which, in this embodiment, is 171 mm apart from the center O of the polishing pad 101, there is obtained a curve S2 having a maximum value of 0.42 seconds.

In this manner, when workpiece 200-3 through 200-6 were disposed at locations P3 through P6 which are apart from the center O of the polishing pad 101 by distances of 180 mm, 189 mm, 198 mm, 207 mm, 216 mm, and 225 mm, respectively, the corresponding sliding contact times take curves S3 through S6.

As can be seen from these curves S1 through S6, the greater the distance of the workpiece 200 from the center O of the polishing pad 101 (i.e., as the workpiece 200 moves from the center O of the polishing pad 101 toward the outer periphery thereof), the maximum value and the curvature of the sliding contact time of each curve decreases.

Accordingly, as shown in FIG. 16, when the workpiece 200 (200-1 through 200-6) is swung or oscillated within the range of a distance L, the time during which the workpiece 200 is in sliding contact with the polishing pad 101 becomes equal to the time in which the curves S1 through S6 are superposed one over another. Superposition of the curves S1 through S6 provides a curve T having a maximum value of about 3 seconds. The curve T takes the shape of an arc which is gently sloping at the central portion thereof designated at a range M, and falls at the inner peripheral portion designated at a range R and the outer peripheral portion designated at a range N. Therefore, the polishing pad 101 is worn out violently in the range M, and lesser in the ranges R and N. As a result, the polishing pad 101 is worn out in the shape of an inverted curve T, resulting in a localized wear, as shown in FIG. 18.

In order to cope with such a localized wear, it is considered to use a polishing pad having a lesser or finer width or another one in the shape of a line ring.

Specifically, as shown in FIG. 17, the curve T is substantially horizontal in a limited range Δ in the vicinity of the top of the curve T, so there will be caused no localized wear. Therefore, if a polishing pad 101 in the shape of a line ring and having a width of Δ while passing through the top position of the curve T is driven to rotate with the workpiece 200 being caused to rotate and oscillate on the line-ring-shaped polishing pad 101, an ideal polishing can be achieved without generating any localized wear on the polishing pad 101. However, when the polishing pad 101 is formed into the line shape in this manner, the area of contact thereof with the workpiece 200 becomes small, thus decreasing the polishing rate.

Another measure to cope with the above problem is that the radius of the polishing pad 101 is made twice or more the diameter of workpiece 200, so that the surface of the polishing pad 101 which is in sliding contact with the workpiece 200 is always changed during swinging or oscillating motion of the workpiece 200.

However, it is not desirable in these days to provide such a large-sized CMP apparatus particular in view of the fact that miniaturization of a CMP apparatus is demanded.

SUMMARY OF THE INVENTION

Thus, the present invention is intended to provide a novel and improved surface planarization apparatus and a workpiece measuring method in which a workpiece can be processed or planarized without reducing a processing or planarization rate and an operating rate of the apparatus, and which is capable of decreasing the overall size of the apparatus as well as measuring the state of processing or planarization of the workpiece at a high degree of accuracy.

According to one aspect of the present invention, there is provided a surface planarization apparatus comprising: a rotatable surface plate; and a pressure member adapted to oscillate a workpiece in a radial direction of the surface plate while urging the workpiece against the surface plate, wherein the surface plate is divided into an inner surface plate member, an intermediate surface plate member and an outer surface plate member which are all disposed in a concentric relation with respect to each other an rotatable independently of each other, the intermediate surface plate member being disposed between the inner and outer surface plate members.

With the above arrangement, by rotating the surface plate and oscillating the work while pressing it against the surface plate by means of the pressure member, the workpiece is processed or planarized by the rotating surface plate. After repeated processing of a lot of workpiece, the intermediate surface plate member is worn out mush greater than the inner and outer surface plate members, with the result that the thickness of the intermediate surface plate member reduces below a predetermined value faster or earlier than the inner and outer surface plate members do. In this case, only the intermediate surface plate member thus worn is detached and replaced with a new one.

In a preferred form of the first aspect of the invention, the number of revolutions per unit time of each of the intermediate surface plate member and the inner and outer surface plate members is set such that a relative speed between the workpiece and the intermediate surface plate member, a relative speed between the workpiece and the inner surface plate member, and a relative speed between the workpiece and the outer surface plate member are all made equal to each other.

With the above arrangement, the speeds of processing (e.g., polishing) of the workpiece by means of the intermediate surface plate member and the inner and outer surface plate members are made substantially equal to each other.

In another preferred form of the first aspect of the invention, the inner and outer surface plate members are made to rotate in the same rotational direction and at the same speed as those of the workpiece.

Thus, the inner and outer surface plate members are made stationary relative to the workpiece, so that the intermediate surface plate member alone contributes to the processing or planarization of the workpiece.

In a further preferred form of the first aspect of the invention, the widths of the inner and outer surface plate members and the intermediate surface plate member are substantially the same with respect to each other.

Thus, the width of the intermediate surface plate member is large, e.g., about one third of the width of the entire surface plate, resulting in an increased area of contact between the intermediate surface plate member and the workpiece, which makes the most contribution to the planarization of the workpiece.

In a further preferred form of the first aspect of the invention, a pad is provided on a surface of each of the inner and outer surface plate members and the intermediate surface plate member.

Thus, by rotating the surface plate and oscillating the workpiece while pressing it against the surface plate by means of the pressure member, the workpiece is planarized or polished by means of the pad on the surface of the surface plate.

In a further preferred form of the first aspect of the invention, the pad of the intermediate surface plate member is formed of a hard material, and the pads of the inner and outer surface plate members are formed of a soft material.

Thus, the workpiece can be planarized or flattened by means of the hard pad and at the same time made uniform by means of the soft pads.

In a further preferred form of the first aspect of the invention, the intermediate surface plate member comprises a plurality of divided surface plate sections disposed in a concentric relation with each other.

In a further preferred form of the first aspect of the invention, a plurality of pads formed of a hard material are each secured to a surface of each of the divided surface plate sections.

According to another aspect of the invention, there is provided a workpiece measuring method adapted to be applied to a surface planarization apparatus which comprises a rotatable surface plate and a pressure member for oscillating a workpiece while urging it against the surface plate, the surface plate comprising a plurality of divided surface plate members concentrically disposed and being rotatable independently of each other, the method comprising the steps of: disposing measuring means in a space between the divided surface plate members at a location through which the workpiece passes in a contactless relation with respect to the divided surface plate members; and measuring the state of planarization of the workpiece which passes through the space by use of the measuring means.

Thus, the measuring means, which is disposed in the space between the divided surface plate members, permits measurements to be conducted at all times without being influenced by the rotation of the divided surface plate members.

In a preferred form of the second aspect of the invention, the workpiece measuring method further comprises the steps of: oscillating the workpiece in a radial direction of the surface plate while rotating it; disposing a first sensor at a first location through which a central portion of the workpiece passes; measuring the state of planarization of the workpiece near a central portion thereof by means of the first sensor; disposing a second sensor in the space at a second location through which a peripheral portion of the workpiece passes; and measuring the state of planarization of the workpiece near the peripheral portion thereof by means of the second sensor.

With the above steps, substantially the central portion of the rotating workpiece is measured by the first sensor and at the same time the peripheral portion of the workpiece is measured by the second sensor, so that the state of processing (e.g., polishing, planarization, uniformity, etc.) of the almost entire surface of the workpiece can be measured by means of the first and second sensors.

In another preferred form of the second aspect of the invention, the workpiece measuring method further comprises the steps of: oscillating the workpiece in a direction substantially perpendicular to a radial direction of the surface plate while rotating the same; disposing a single sensor in the space at a location through which a central portion of the workpiece passes; and measuring the state of planarization of the workpiece over a range from the central portion to a peripheral portion thereof by means of the single sensor.

With the above steps, measurements are effected from the center of the workpiece to the peripheral portion thereof, so the state of processing of the almost entire surface of the workpiece can be measured by use of the single sensor.

The above and other objects, features and advantages of the present invention will more readily apparent to those skilled in the art from the following detailed description of the invention taken in conjunction with the accompanying drawings.

DESCRIPTION OF THE PREFERRED EMBODIMENTS

In the following, preferred embodiments of the present invention will be described while referring to the accompanying drawings.

The First Embodiment

Figure 1:
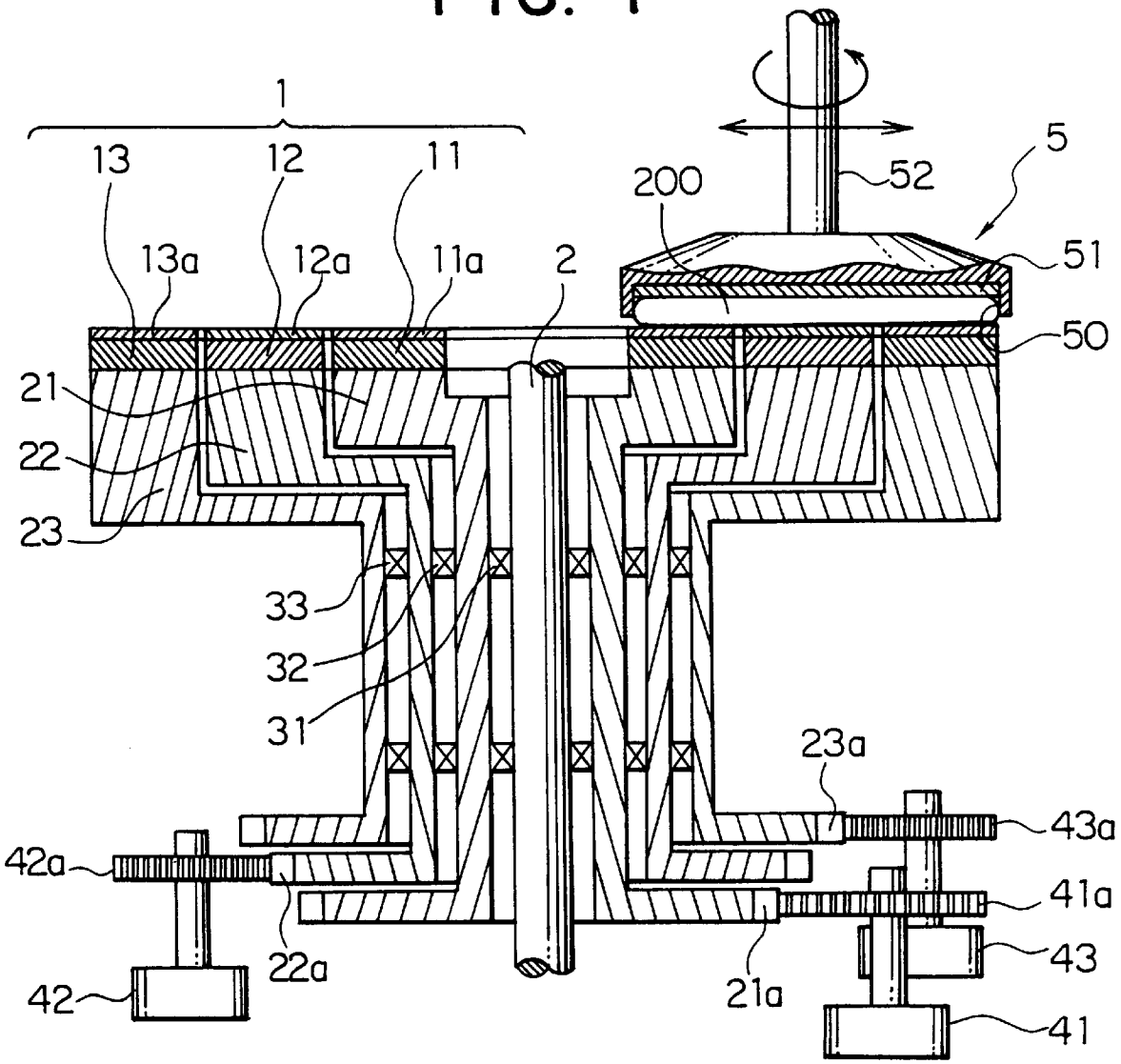
FIG. 1 is a cross section showing a polishing apparatus according to a first embodiment of the present invention.

FIG. 1 shows in cross section a surface planarization apparatus in the form of a polishing apparatus according to a first embodiment of the present invention.

The polishing apparatus is a CMP apparatus which has a surface plate 1 and a pressure member in the form of a carrier 5. The surface plate 1 comprises three divided surface plate members including an inner surface plate member 11, an intermediate surface plate member 12, and an outer surface plate member 13, which are mounted on upper surfaces of similarly divided corresponding rotating members or rotors 21, 22, 23, respectively.

Specifically, the rotor 21 is rotatably mounted through a bearing 31 outside of the central shaft 2. The rotors 22, 23 are rotatably sequentially mounted through bearings 32, 33 outside of the rotor 21. These rotors 21, 22, 23 have toothed portions 21*a*, 22*a*, 23*a* formed on their lower portions, respectively. The toothed portions 21*a*, 22*a*, 23*a* are in meshing engagement with gear wheels 41*a*, 42*a*, 43*a* which are provided on rotation shafts of drive members 41, 42, 43, respectively. By actuating the drive members 41–43, the rotors 21–23 are driven to rotate around the central shaft 2. The rotors 21–23 have upper portions of substantially the same width and each being in the shape of a ring.

The inner surface plate member 11, the intermediate surface plate member 12, and the outer surface plate member 13 are mounted detachably to the top faces of the upper portions of the rotors 21–23. The inner surface plate member 11 is formed of a metallic ring of the same width as that of the upper portion of the rotor 21. A pad in the form of a polishing pad 11*a* is attached or adhered to a surface of the inner surface plate member 11.

Similarly, the intermediate surface plate member 12 and the outer surface plate member 13 are formed of metallic rings of the same widths as those of the upper portions of the rotors 22, 23, respectively. Also, pads in the form of polishing pads 12*a*, 13*a* are attached or adhered to surfaces of the intermediate surface plate member 12 and the outer surface plate member 13, respectively.

That is, the inner surface plate member 11, the intermediate surface plate member 12 and the outer surface plate member 13 having the polishing pads 11*a*–13*a* have substantially the same widths, and are disposed concentrically around the central shaft 2 so that they are driven to rotate independently of each other by means of the drive members 41–43.

The widths of the inner surface plate member 11, the intermediate surface plate member 12 and the outer surface plate member 13 are described below.

Figure 17:
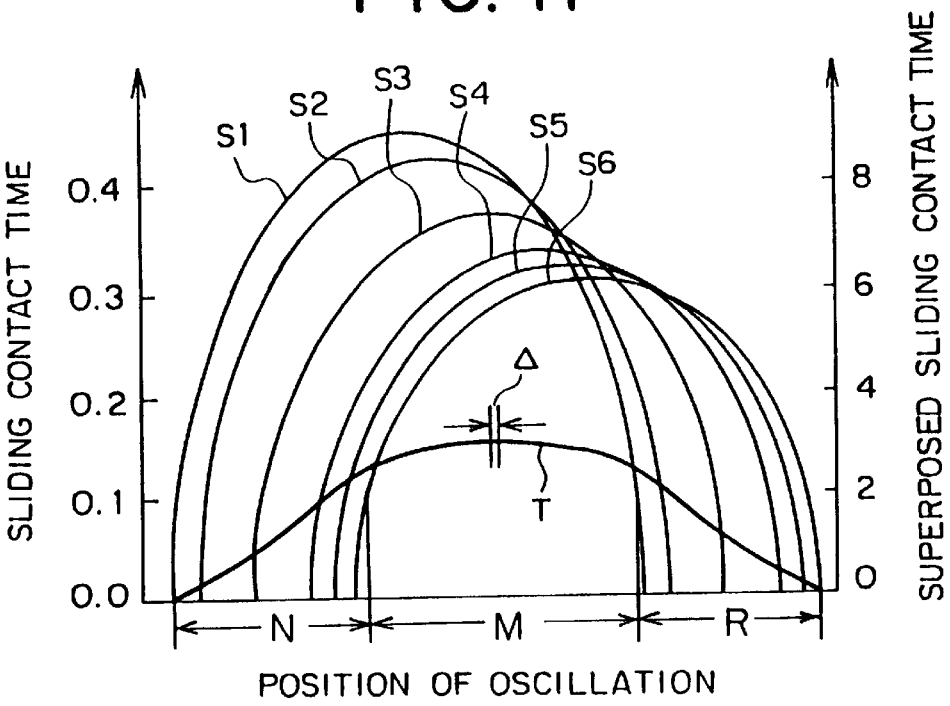
FIG. 17 is a diagram showing the time of sliding contact, in which the left-hand ordinate axis indicates the sliding contact time at respective positions of oscillation, and the right-hand ordinate axis indicates the time value of the sliding contact time superimposed at respective positions of oscillation.
Figure 18:
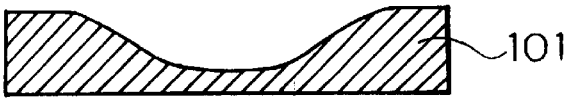
FIG. 18 is a cross section showing the state of localized wear of one polishing pad.

As shown in the curve T in FIG. 17, the part within the range M of the polishing pad is worn out most when the work is oscillated. Moreover, the curvature of the curve T in the part within the range M is very small, and hence the part or range M is substantially flat. As a consequence, the phenomenon of localized wear is hardly caused in the part within the range M. For this reason, the width of the intermediate surface plate member 12 is set to substantially the same size as the range M, and the widths of the inner surface plate member 11 and the outer surface plate member 13 are each set to substantially the same width of the intermediate surface plate member 12.

Figure 2:
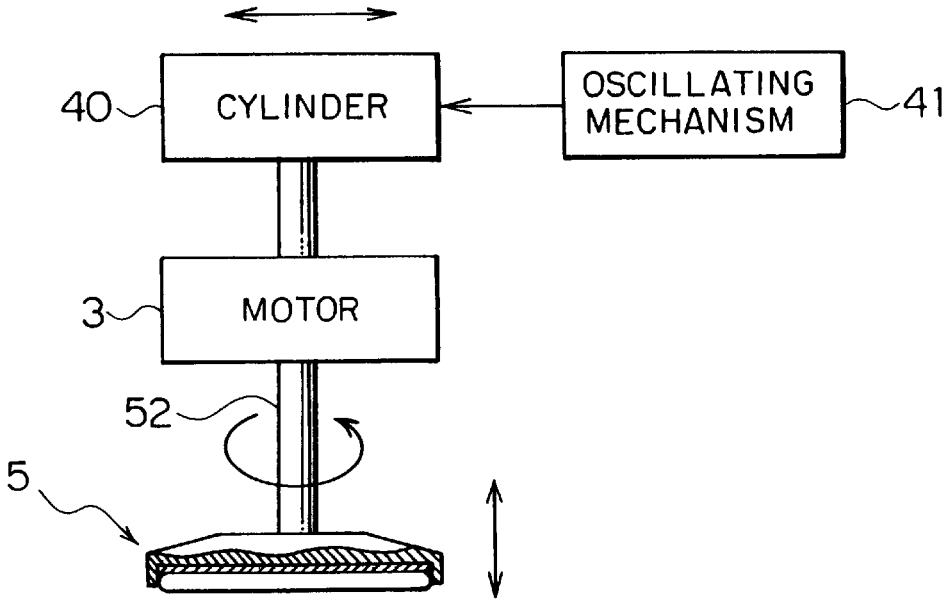
FIG. 2 is a block diagram showing a drive mechanism for a carrier.

On the other hand, in FIG. 1, the carrier 5 is formed on a first or lower surface thereof with a circular work holding recess or opening 50 in which a packing pad 51 is received, the packing pad 51 being secured or adhered to the lower surface of the carrier 5. A rod 52 is vertically mounted at its one or lower end on a second or upper surface of the carrier 5. The rod 52 is connected at its other or upper end with a motor 3, as shown in FIG. 2, so that the carrier 5 is driven to rotate on its own axis of rotation under the drive of the motor 3 through the rod 52. The motor 3 is operably connected with a cylinder 40 so that the carrier 5 can be caused to move vertically by means of the cylinder 40 through the intermediary of the motor 3. The cylinder 40 is operably connected with an oscillating mechanism 41 so that the whole of the cylinder 40, the motor 3 and the carrier 5 can be oscillated laterally or to the right and left of FIG. 2 under the action of the oscillating mechanism 41.

Next, the operation of the polishing apparatus according to this embodiment will be described below.

As shown in FIG. 1, the carrier 5 holding the workpiece 200 is driven to rotate on its own axis by means of the motor 3 (see FIG. 2) and at the same time to move in a downward direction under the action of the cylinder 40. In this state, when the oscillating mechanism 41 is actuated to oscillate or swing the carrier 5 in a radial direction of the surface plate 1, i.e., to the right and left of FIG. 1, the workpiece 200 is caused to oscillate or swing on the surface plate 1 while being pressed thereagainst.

Simultaneous with this operation, the Inner surface plate member 11, the intermediate surface plate member 12 and the outer surface plate member 13 of the surface plate 1 are driven to rotate by means of the drive members 41–43 while an unillustrated polishing medium such as a polishing liquid is being supplied thereto.

Figure 3:
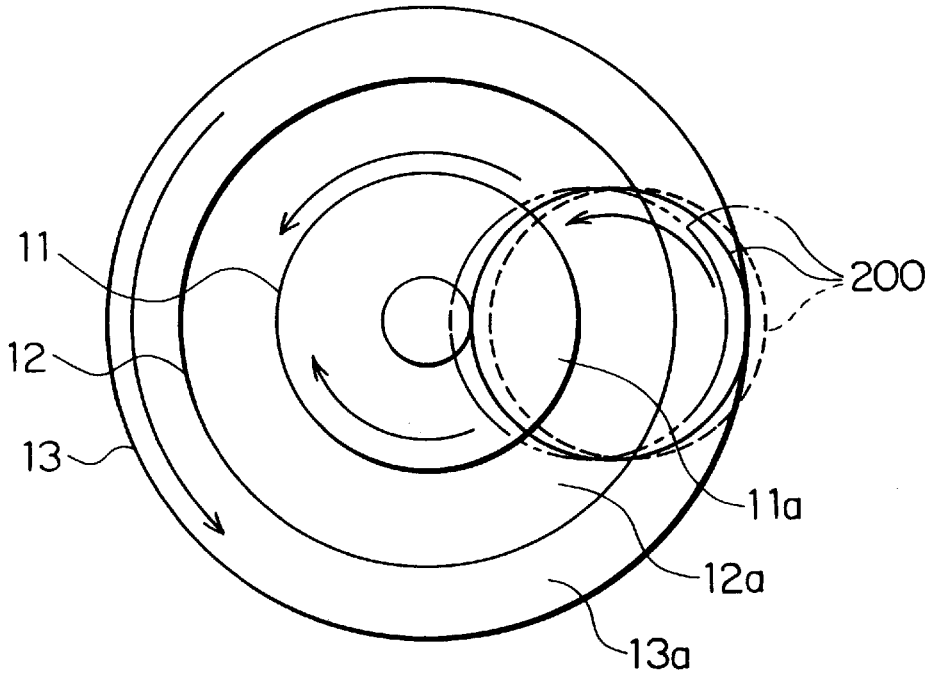
FIG. 3 is a plan view showing the right-hand or clockwise rotation of each of the surface plate members.

Specifically, the intermediate surface plate member 12 is driven to rotate by the drive member 42 in the same rotational direction as the direction of self rotation of the workpiece 200, as shown in FIG. 3. At this time, the number of revolutions per unit time or rotating speed of the intermediate surface plate member 12 and that of the workpiece 200 are set to the same value.

Furthermore, the inner surface plate member 11 is driven to rotate by the oscillating mechanism 41 in a direction opposite the direction of self rotation of the workpiece 200. At this time, the number of revolutions per unit time or rotating speed of the inner surface plate member 11 is set in such a manner as to minimize the relative speed of that part thereof which contacts the workpiece 200 with respect to the rotating speed of the latter.

In addition, the outer surface plate member 13 is rotated by the drive member 43 in the same direction as the direction of self rotation of the workpiece 200. In this regard, the number of revolutions per unit time of the outer surface plate member 13 is appropriately set so as to minimize the relative speed of the part thereof contacting the workpiece 200 with respect to the rotating speed of the latter.

Specifically, the direction of rotation and the number of revolutions per unit time of each of the inner surface plate member 11 and the outer surface plate member 13 are set in such a manner that the polishing pads 11*a*, 13*a* on the inner surface plate member 11 and the outer surface plate member 13 are made substantially stationary relative to the workpiece 200.

Also, the rotational direction and the number of revolutions per unit time of the intermediate surface plate member 12 is set such that the polishing pad 12*a* of the intermediate surface plate member 12 can make the most contribution to the polishing of the workpiece 200. Thus, the work 200, which is caused to oscillate while rotating on its own axis, is polished by the rotating surface plate 1. At this time, the inner and outer surface plate members 11, 13 are substantially stationary relative to the workpiece 200, and hence they are in a state of merely supporting the work 200 on its opposite sides. As a consequence, the polishing pads 11*a*, 13*a* are not worn out to any substantial extent.

The entire lower surface of the workpiece 200, which is made into contact with the polishing pad 12*a* during self rotation and oscillating motion of the workpiece 200, is polished by the polishing pad 12*a*. Therefore, the polishing pad 12*a* might be worn out, and a localized wear might be caused to the polishing pad 12*a*. If localized wear is generated, the workpiece 200 can not uniformly contact the polishing pad 12*a*, and there will be irregularities or localization in the polishing of the workpiece 200.

In this case, however, as described above, the width of the polishing pad 12*a* is set substantially equal to the range M as shown in FIG. 17 so that the polishing pad 12*a* is worn out substantially flatly, thus hardly causing any localized wear on the polishing pad 12*a*. Therefore, there will be substantially no or little localization or irregularities in the polishing of the workpiece 200, as a result of which the workpiece 200 can be flattened or planarized at a high polishing rate.

Figure 4:
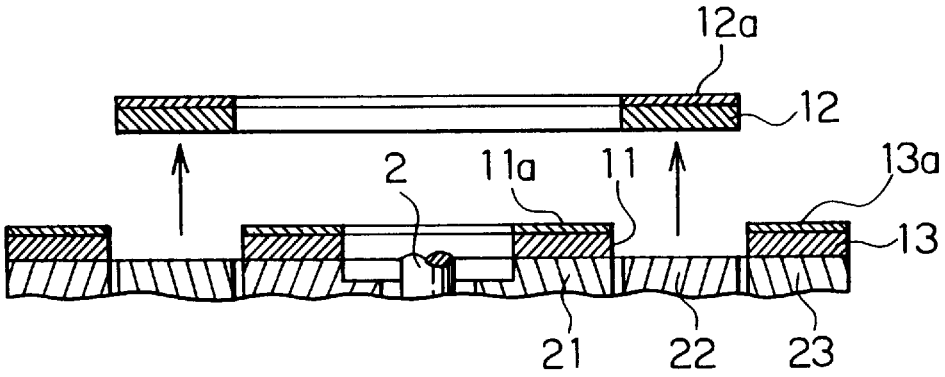
FIG. 4 is a cross section showing the detached state of an intermediate surface plate member.

In cases where the polishing pad 12*a* has been worn out more than a predetermined value (e.g., 60% of the original thickness) after repeated polishing operations, the heavily worn intermediate surface plate member 12 alone is detached from the rotor 22, as shown in FIG. 4, and replaced with a new one to which a new polishing pad is adhered.

As described above, according to the polishing apparatus of this embodiment, the polishing operation can be continued or resumed at one with a limited time loss only by exchanging the used intermediate surface plate member 12 having the worn-out polishing pad 12*a* alone, so down time of the apparatus can be shortened, thus improving the operating rate of the apparatus.

Furthermore, since the polishing pad 12*a* is uniformly worn out, the operator has only to observe the surface roughness thereof, and hence control of the polishing pad 12*a* is easy.

In addition, the inner surface plate member 11 and the outer surface plate member 13 are substantially in a stationary state relative to the work 200, so they are hardly worn out, thus prolonging the life time of the surface plate 1.

Moreover, in cases where the inner surface plate member 11, the intermediate surface plate member 12 and the outer surface plate member 13 have been worn out and have to be replaced with new ones, these mutually divided surface plate members can be detached and exchanged separately with new ones without difficulty. That is, in the past, it was necessary to detach and mount a single large-sized and heavily-weighted surface plate 100, and hence an exchange of the surface plate 100 was cumbersome and difficult.

However, by dividing the surface plate 1 into three in this embodiment, the small-sized and light-weighted inner, intermediate and outer surface plate members 11, 12, 13 can be exchanged separately from each other, thus achieving a speedy and easy exchange with less trouble and difficulty.

Furthermore, since the width of the intermediate surface plate member 12 is set substantially equal to the range M indicated in FIG. 17, a great area of contact of the polishing pad 12*a* with the workpiece 200 is ensured, thus resulting in an extremely high polishing rate.

Still further, in the above-mentioned known technique, a large-sized surface plate having a radius twice or more the diameter of the work is required for preventing localized wear of the polishing pad while keeping a required area of contact thereof with the workpiece 200.

However, by employing the surface plate 1 of a three-divided structure including the inner, intermediate and outer surface plate members 11, 12, 14 as in the CMP apparatus of this embodiment, it is possible to achieve substantially the same results even with a limited swing or oscillating distance of the workpiece 200. As a result, the surface plate 1 can be miniaturized.

Further, in the past, it was necessary to rotate the large-sized surface plate of a heavy weight, and it was difficult to achieve a high-speed rotation of the surface plate, but with the CMP apparatus of this embodiment, the surface plate 1 is divided into three, resulting a substantially reduced weight of the intermediate surface plate member 12 which is to be rotated.

Consequently, the polishing pad 12*a* can be made substantially hard by rotating the intermediate surface plate member 12, which contributes to the polishing, at high speed. As a result, a highly accurate flattening or planarization of the workpiece 200 can be achieved.

(The Second Embodiment)

Figure 5:
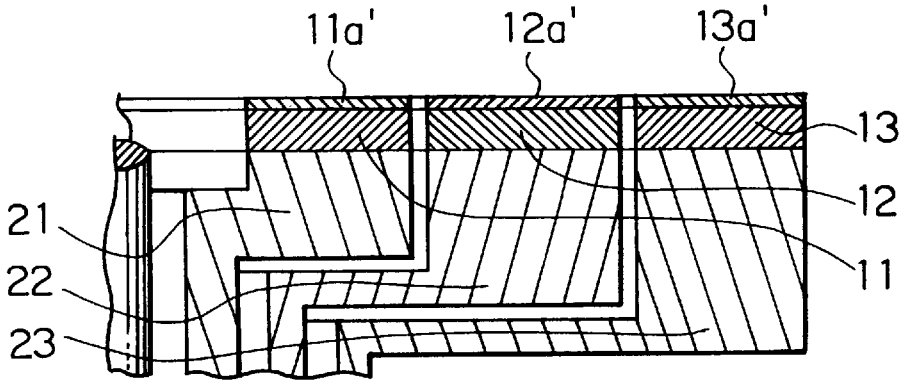
FIG. 5 is a cross section showing the essential parts of a CMP apparatus according to a second embodiment of the present invention.

FIG. 5 shows in cross section the essential parts of a CMP apparatus according to a second embodiment of the present invention.

In general, a workpiece is not completely flat or planar. For instance, a workpiece such as a wafer generally includes warpage and/or distortions which were caused by heating during processing. Also, the workpiece includes steps on an irregular or ruggedness surface resulting from wiring patterns formed thereon.

As a consequence, when polishing such a workpiece, a polishing pad requires flatness for reducing steps in the regularities, and uniformity by which the polishing pad is deformable so as to follow warpage and/or irregularities on the surface of the workpiece to polish a surface layer to a constant thickness.

The CMP apparatus of this embodiment can satisfy the above-mentioned requirements by the use of a single-layer polishing pad. The hardness of the polishing pads to be adhered to the inner surface plate member 11, the intermediate surface plate member 12 and the outer surface plate member 13 is varied.

Specifically, soft polishing pads 11*a'*, 13*a'* in the form of a SUBA-IV pad are attached or adhered to the inner surface plate member 11 and the outer surface plate member 13, and a hard polishing pad 12*a*' in the form of an IC-1000 urethane pad is attached or adhered to the intermediate surface plate member 12.

In the operation of this CMP apparatus, the rotational directions of the inner surface plate member 11, the intermediate surface plate member 12 and the outer surface plate member 13 are the same as in the case of the above-mentioned first embodiment, but the rotating speeds of the inner surface plate member 11 and the outer surface plate member 13 are different from those in the case of the above-mentioned first embodiment.

That is, in the second embodiment, the rotating speeds of the inner surface plate member 11 and the outer surface plate member 13 are set in such a manner that the relative speeds of the soft polishing pads 11*a'*, 13*a'* with respect to the workpiece 200 are great enough to polish the work 200 by means of the soft polishing pads 11*a'*, 13*a'*.

Figure 6:
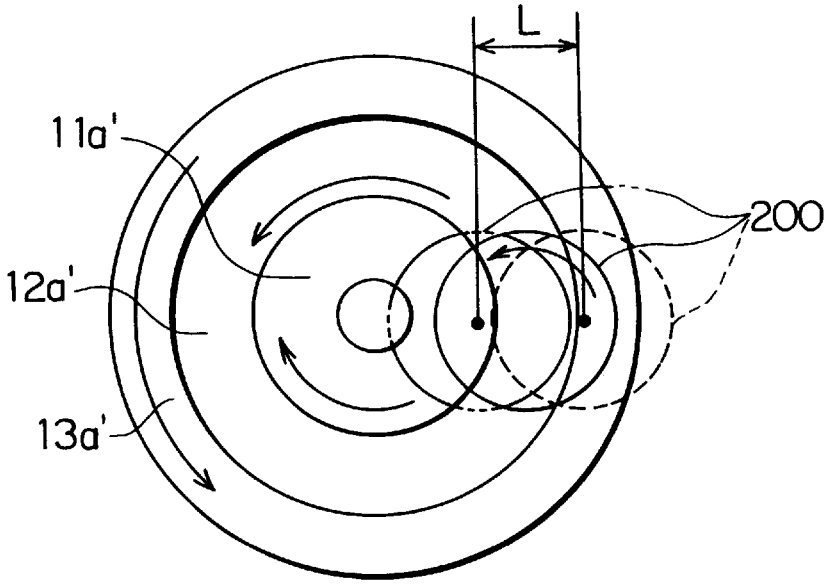
FIG. 6 is a plan view showing the swinging or oscillating state of a workpiece.

In addition, as shown in FIG. 6, the carrier 5 is controlled in such a manner that the swing or oscillating distance L of the workpiece 200 is greater than the width of the hard polishing pad 12*a*'.

Figure 7:
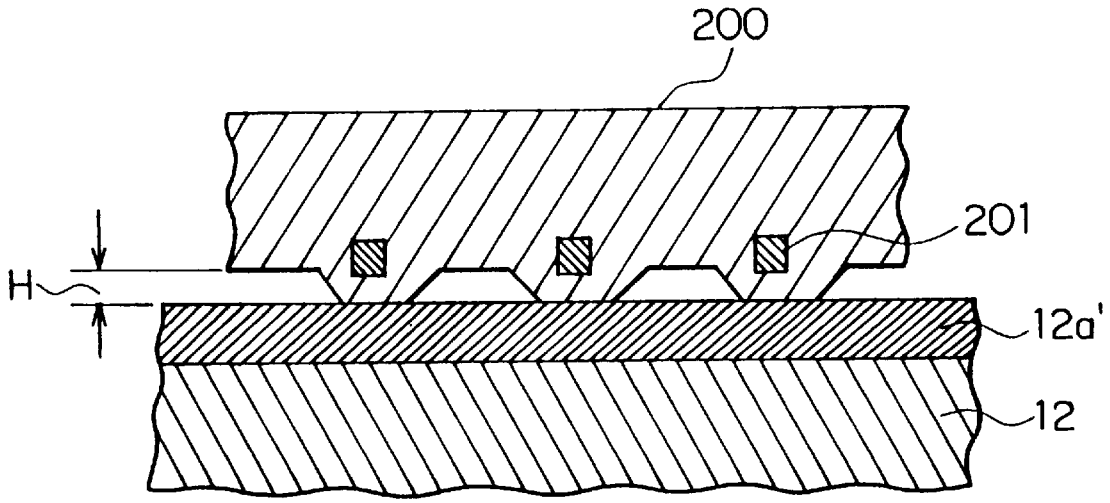
FIG. 7 is a cross section showing a flattening or planarization operation by means of a hard polishing pad.

Thus, as indicated by the solid line in FIG. 6, the workpiece 200 when existing on the hard polishing pad 12*a*' polishes convex portions which are caused by the wiring pattern 201 of the workpiece 200, thereby reducing steps H, as shown in FIG. 7, so that the workpiece 200 is flattened or planarized by the hard polishing pad 12*a* '.

Figure 8:
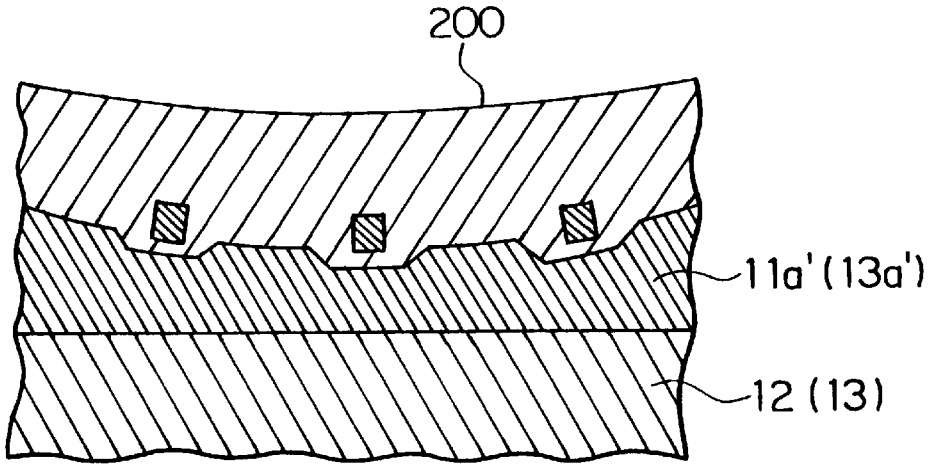
FIG. 8 is a cross section showing a uniform or non-localized processing by a soft polishing pad.

On the other hand, when the workpiece 200 exists on the soft polishing pads 11*a'*, 13*a'*, as shown by a short dashes line and an alternate long and two short dashes line in FIG. 6, the soft polishing pads 11*a'*, 13*a'* are deformed so as to follow the ruggedness and/or warpage of the workpiece 200, thereby polishing the surface of the workpiece 200 in a uniform manner, as shown in FIG. 8. As a consequence, the surface of the workpiece 200 is made uniform by means of the soft polishing pads 11*a'*, 13*a'*.

In this manner, according to the CMP apparatus of the second embodiment, the workpiece 200 can be flattened or planarized and made uniform by means of the single-layer polishing pad comprising the soft polishing pads 11*a'*, 13*a'* and the hard polishing pad 12*a* '.

As a technique to achieve such flatness and uniformity with a single CMP apparatus, it is generally known that a soft polishing pad and a hard polishing pad are disposed one over the other on a single surface plate so as to flatten or planarize the surface of a workpiece by means of the hard polishing pad while following warpage and the like of the workpiece by means of the soft polishing pad.

With such a technique, however, two wide polishing pads each corresponding in area to the single surface plate are required, thus increasing the cost of parts.

In contrast to this, the CMP apparatus of this embodiment only requires one polishing pad of a single layer, so the cost of parts can be suppressed or reduced to a substantial extent.

The construction and operation of this second embodiment other than the above are similar to those of the above-mentioned first embodiment, and hence a description thereof is omitted.

(The Third Embodiment)

Figure 9:
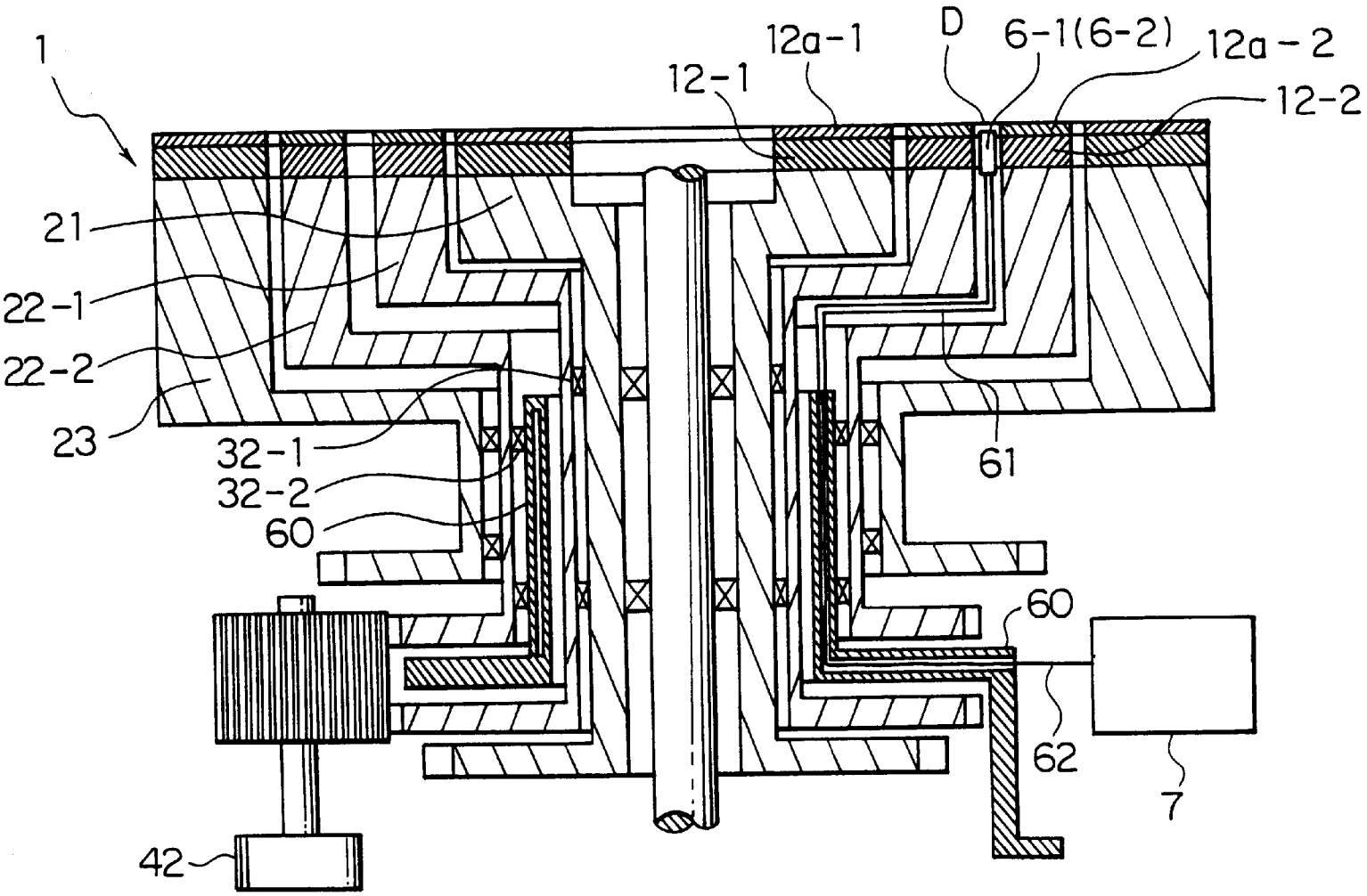
FIG. 9 is a cross section of a CMP apparatus according to a third embodiment of the present invention.

FIG. 9 shows in cross section a CMP apparatus according to a third embodiment of the present invention. The CMP apparatus of this embodiment achieves a workpiece measuring method of the present invention.

This CMP apparatus is different from those of the above-mentioned first and second embodiments in the provision of a measuring device for measuring the thickness of a workpiece through a space between surface plate members. The measuring device comprises two laser sensors 6-1, 6-2 and a computing unit 7. The laser sensors 6-1, 6-2 are disposed in an annular space P defined between two concentrically disposed intermediate surface plate sections 12-1, 12-2.

Specifically, a first intermediate rotor 22-1 is rotatably mounted on an inner rotor 21 through a bearing 32-1. A hollow stationary member 60 is fixedly provided outside the rotor 22-1. A second intermediate rotor 22-2 is rotatably mounted on the stationary member 60 through a bearing 32-2. These first and second intermediate rotors 22-1 and 22-2 are driven to integrally rotate by means of a drive member 42.

The first and second intermediate surface plate sections 12-1, 12-2 having polishing pads 12*a*-1, 12*a*-2, respectively, are detachably mounted on the first and second intermediate rotors 22-1, 22-2. The sum of the widths of the polishing pads 12*a*-1, 12*a*-2 is set substantially equal to the range M indicated in FIG. 17.

The laser sensors 6-1, 6-2 are disposed in the annular space D in such a manner as not to contact these intermediate surface plate sections 12-1, 12-2. The laser sensors 6-1, 6-2 are each attached to or held on an upper end of a hard tubing 61 which is connected with an upper end of the stationary member 60, the tubing 60 being disposed in and extending through the space D between the first and second intermediate rotors 22-1, 22-2.

Each of the laser sensors 6-1, 6-2 disposed in this manner is a well-known device which irradiates a laser beam to the workpiece 200 so as to measure the thickness of the work 200, and outputs a signal indicative of the measurement value to the computing unit 7.

A lead wire 62 extending from each laser sensor 6-1(6-2) is passed through the tubing 61 and the stationary member 60, drawn out from a lower side of the stationary member 60, and connected to the computing unit 7.

Figure 10:
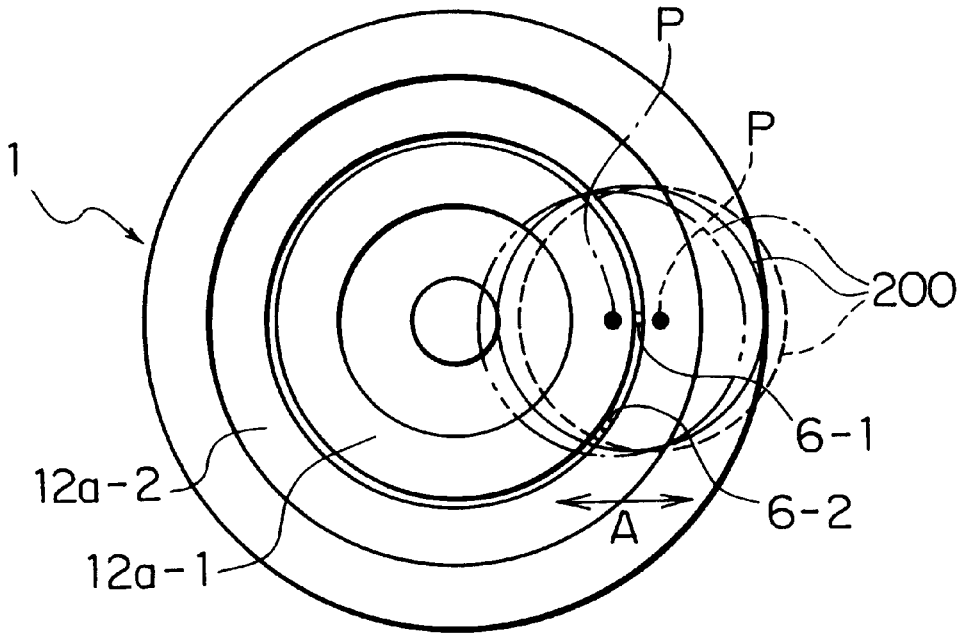
FIG. 10 is a plan view showing the arrangement of laser sensors.

The two laser sensors 6-1, 6-2 are respectively disposed at predetermined locations within the annular space D. Specifically, the laser sensor 6-1 is disposed at a location through which the central portion of the workpiece 200 passes when it swings or oscillates in the direction of arrow A (i.e., in a radial direction of the surface plate 1) while rotating on its own axis, as shown in FIG. 10. The laser sensor 6-2 is disposed at a location through which a peripheral portion of the workpiece 200 passes.

On the other hand, the computing unit 7 is a well-known device which can arithmetically operate or compute the flatness and/or uniformity of the workpiece 200 based on the measured value of the thickness of the workpiece 200 which is indicated by the signals from the laser sensors 6-1, 6-2.

Next, the operation of the CMP apparatus of the third embodiment will be described.

As shown in FIG. 10, when the workpiece 200 is swinging or oscillating in the direction of arrow A while rotating on its own axis, the laser sensor 6-1 measures the thickness of the workpiece 200 every time the workpiece 200 passes right above the laser sensor 6-1 and generates a corresponding signal to the computing unit 7 which computes the thickness of that portion of the workpiece 200 which passes right above the laser sensor 6-1.

Figure 11:
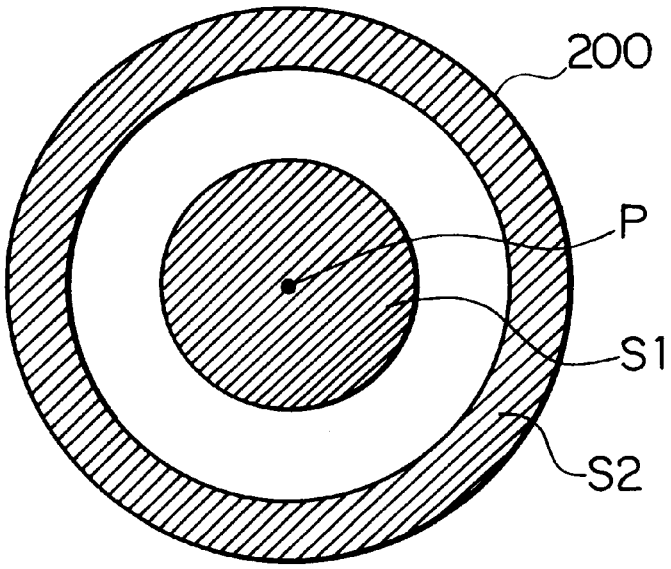
FIG. 11 is a plan view showing measurement areas of the laser sensors

In this case, since the workpiece 200 is repeatedly oscillated while rotating on its own axis, the laser sensor 6-1 measures the thickness of a circular area S1 of the workpiece 200 which is in the vicinity of the central point P of the workpiece 200 and has a diameter equal to the length or distance of oscillation of the workpiece 200, as illustrated in FIG. 11. The computing unit 7 computes the thickness of the circular area S1.

Furthermore, the laser sensor 6-2 measures a peripheral portion of the workpiece 200. Since the work 200 is repeatedly swung or oscillated while rotating on its own axis, the thickness of a ring-shaped or annular area S2 in the peripheral portion of the workpiece 200 is measured by the laser sensor 6-2, as shown in FIG. 11.

Therefore, in this embodiment, by making the length or distance of the swinging or oscillating movement of the workpiece 200 great, and by bringing the position of the laser sensor 6-2 close to the central point P of the workpiece 200, it is possible to measure the thickness of respective portions of the workpiece 200 substantially over the entire surface thereof.

Moreover, uniformity of the lower surface of the workpiece 200 can be determined from the measured value of the laser sensor 6-1 subtracted by the measured value of the laser sensor 6-2, and at the same time, the state of ruggedness or irregularities of the polishing indicative of the condition of processing can also be seen.

That is, when the balance or subtracted value is a positive value, the lower surface of the workpiece 200 is convex, whereas when it is a negative value, the lower surface of the workpiece 200 is concave.

As can be seen from the foregoing, according to the CMP apparatus of this embodiment, the operation timing of the laser sensors 6-1, 6-2 need not be considered, so it is possible to measure the flatness and uniformity of the workpiece 200 at a high degree of accuracy through simple and easy measurement control.

Further, since the space D is not a small hole but a ring-shaped or annular space, it is possible to avoid a situation that a polishing liquid collected in the space D might preclude measurements of the laser sensors 6-1, 6-2.

Since the construction and operation of this third embodiment other than the above are similar to those of the above-mentioned first and second embodiments, a description thereof is omitted.

(The Fourth Embodiment)

A fourth embodiment of the present invention relates to a workpiece measuring method which is practically carried out by utilizing the CMP apparatus according to the above-mentioned third embodiment.

Figure 12:
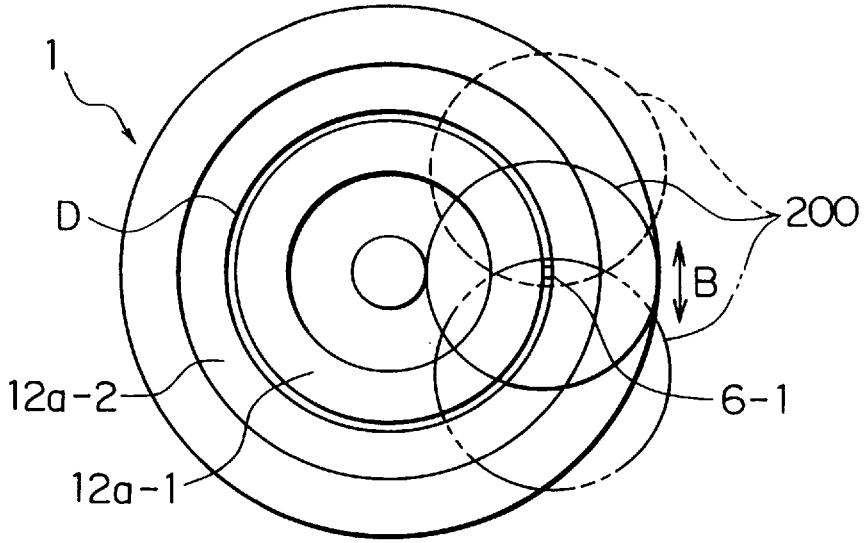
FIG. 12 is a plan view showing a workpiece measuring method according to a fourth embodiment of the present invention.
Figure 13:
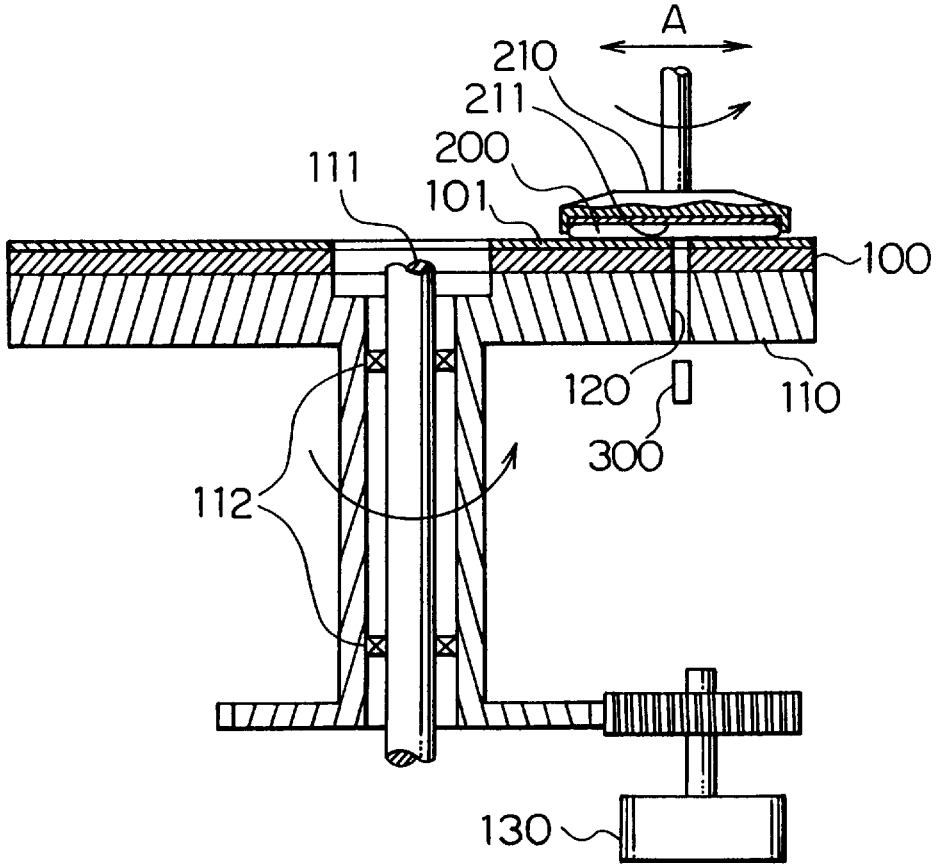
FIG. 13 is a cross section showing a known CMP apparatus.
Figure 14:
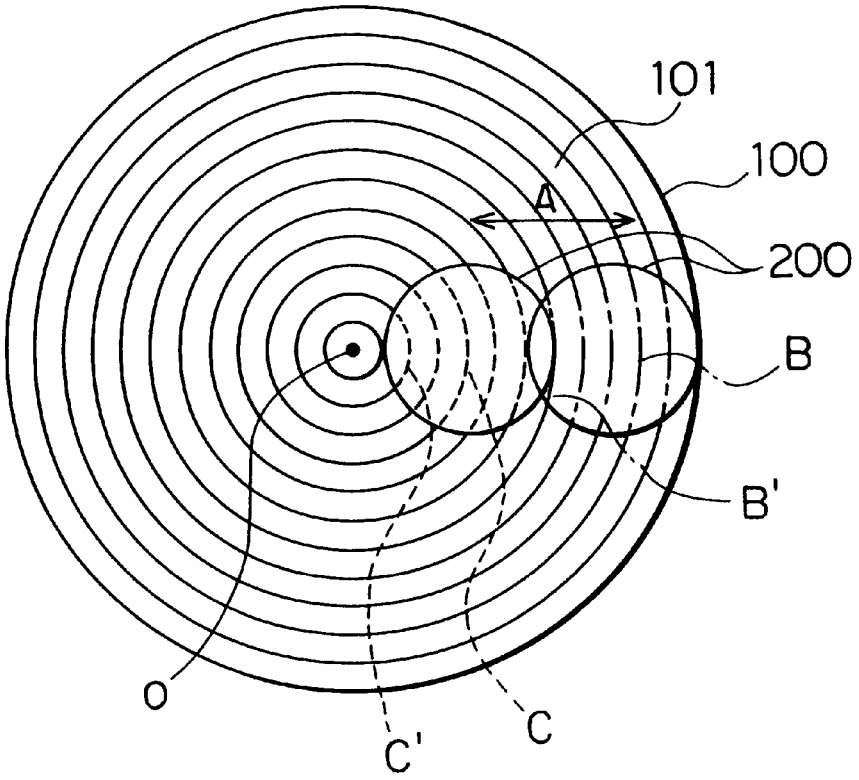
FIG. 14 is a schematic plan view showing the swinging or oscillating state of a workpiece.
Figure 15:
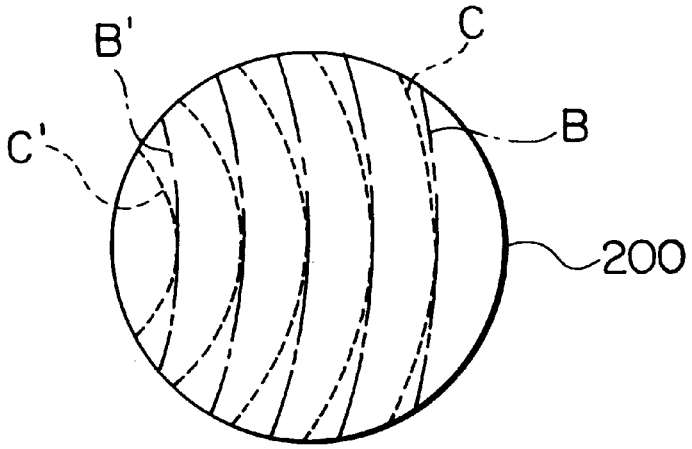
FIG. 15 is a comparison chart where sliding contact lines in FIG. 14 are superposed.
Figure 16:
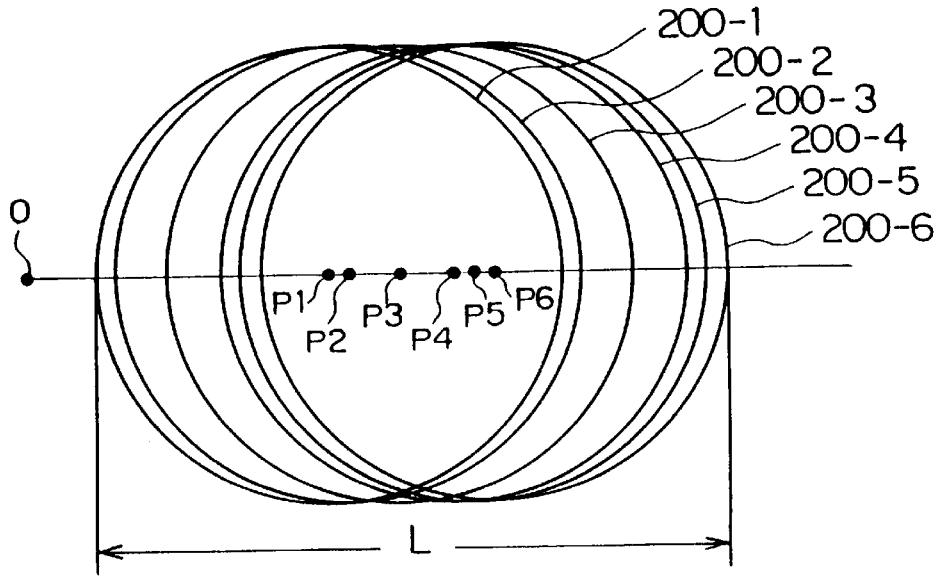
FIG. 16 is a schematic plan view showing varying positions of the workpiece during its swinging or oscillating movement.

FIG. 12 shown in a plan view the workpiece measuring method according to the fourth embodiment of the present invention. In this embodiment, the workpiece 200 is oscillated in a direction perpendicular to a radial direction of the surface plate 1 as indicated by arrow B in FIG. 12, i.e., in a tangential direction of the annular space D.

Specifically, the workpiece 200 is oscillated such that the central point P of the workpiece 200 passes right above the laser sensor 6-1, and the lower end of the peripheral portion of the workpiece 200, which is at an uppermost position in FIG. 12 as indicated by a short dashes line, is located right above the laser sensor 6-1, and the upper end of the peripheral portion of the workpiece 200, which is at a lowermost position in FIG. 12 as indicated by an alternate long and two short dashes line, is located right above the laser sensor 6-1.

With this arrangement, the laser sensor 6-1 measures the thickness of the workpiece 200 from its central point P to its peripheral portion edge, so that the entire lower surface of the workpiece 200 is measured by use on only one laser sensor 6-1 when the workpiece 200 is oscillated in the direction of arrow B while rotating on its own axis.

The construction and operation of the fourth embodiment are similar to those of the above-mentioned first to third embodiments, and thus a description thereof is omitted.

Here, it is to be noted that the present invention is not limited to the above-mentioned embodiments, but various changes or modifications can be made within the spirit and scope of the invention as defined in the appended claims.

In the above-mentioned embodiments, the CMP apparatus has been consistently described, but the present invention can also be applied to other apparatuses.

For instance, in a one-side lapping apparatus which can flatten or planarize a surface of a workpiece by rotating it while urging it against a lower surface plate by means of a pressure member in the form of a head which is swung or oscillated, dividing the lower surface plate into a plurality of surface plate members can achieve substantially the same results as with the CMP apparatus according to any one of the above-mentioned embodiments.

Also, in a one-side polishing apparatus which can perform a delicate polishing by means of a pressure member in the form of a head and a lower surface plate having a polishing pad adhered thereto, dividing the lower surface plate and the polishing pad into a plurality of pieces can achieve substantially the same results.

Furthermore, in the above-mentioned embodiments, the widths of the inner surface plate member, the intermediate surface plate member and the outer surface plate member are set substantially equal to each other, but it is evident that the widths of these members may be different from each other as long as the width of the intermediate surface plate member is substantially equal to or less than the range M indicated in FIG. 17.

Although in the above-mentioned second embodiment, the soft polishing pads 11*a'*, 13*a'* comprise SUBA-IV pads and the hard polishing pad 12*a'* comprises a IC-1000 urethane pad, the present invention is not limited to the use of these pads but any other suitable pads can instead be employed.

Specifically, the soft polishing pads 11*a'*, 13*a'* can be formed of any suitable soft material which is able to deform so as to follow warpage and the like of the workpiece 200. Also, the hard polishing pad 12*a'* can be formed of any suitable hard material which is able to flatten or planarize a surface of the workpiece 200.

Moreover, the rotational direction and the rotating speed of each of the inner surface plate member, the intermediate surface plate member and the outer surface plate member can optionally be determined according to the contents of an operation or job required, and thus these are not limited to what is disclosed in the above-mentioned embodiments.

For instance, the number of revolutions per unit time of each of the intermediate surface plate member, the inner surface plate member and the outer surface plate member can be set such that the relative speed between the work and the intermediate surface plate member, the relative speed between the workpiece and the inner surface plate member and the relative speed between the workpiece and the outer surface plate member are made equal to each other.

With such settings, the speeds or rates of polishing or planarization of the workpiece by means of the intermediate surface plate member, the inner surface plate member and the outer surface plate member can be made the same.

In addition, in the above-mentioned embodiments, dividing the surface plate into three or four pieces has been described by way of example, but the specific number of pieces is arbitrary.

As described above in detail, the following advantages will be obtained according to the present invention.

The surface plate is divided into the inner surface plate member, the outer surface plate member and the intermediate surface plate member, so that when the surface plate has been subjected to localized wear, the operation or processing can be continued or resumed at once merely by exchanging the intermediate surface plate member alone which has been worn out violently. Thus, the down time of the apparatus can be shorted, improving the operating ratio to a considerable extent.

Furthermore, even when the entire surface plate is to be exchanged, the divided surface plate members each of a relatively light weight can be exchanged separately or independently of each other, so that replacement of the surface plate can be done swiftly and easily.

By making the speeds or rates of processing or planarization of the workpiece by means of the respective surface plate members equal to each other, a uniform processing or planarization of the workpiece can be carried out reliably in a short time.

The inner surface plate member and the outer surface plate member are made substantially stationary relative to the workpiece, so there will be substantially no wear of the inner surface plate member and the outer surface plate member. As a result, it is possible to accordingly prolong the useful life of the surface plate.

Moreover, a large area of contact between the intermediate surface plate member and the workpiece can be ensured, thus achieving a further improvement in the rate of processing or planarization.

Since polishing pads are provided on the intermediate surface plate member, the inner surface plate member and the outer surface plate member, the apparatus of the present invention can be used as various kinds of apparatuses such as a CMP apparatus. In these apparatuses, too, it is possible to improve the operating rate and the processing or planarization rate, prolong the life time of the surface plate, and reduce the whole size.

By use of the single-layer polishing pads comprising soft polishing pads and a hard polishing pad, both planarization and uniformity of the workpiece can be achieved, thus making it possible to reduce the cost of parts.

The state of processing of planarization of the workpiece can be measured at all times without being influenced by the rotation of the surface plate, so that no consideration need be given to the timing of rotation of the hole 120 and irradiation of a laser beam as in the case of the known laser sensor 300. Consequently, the control of measurements can be simplified, and a highly accurate measurement of the workpiece can be made.

In one embodiment, the state of processing or planarization of the almost entire surface of the workpiece can be measured by means of first and second sensors, so it is possible to further improve the accurate in the measurements.

In another embodiment, the state of processing or planarization of the almost entire surface of the workpiece can be measured by use of a single sensor, so it is possible to decrease the cost of measuring equipment.

What is claimed is:

1. A workpiece measuring method adapted to be applied to a surface planarization apparatus which comprises a rotatable surface plate and a pressure member for oscillating a workpiece while urging it against said surface plate, said surface plate comprising a plurality of divided surface plate members concentrically disposed and being rotatable independently of each other, said method comprising the steps of:

disposing measuring means in a space between said divided surface plate members at a location through which said workpiece passes in a contactless relation with respect to said divided surface plate members; and measuring the state of planarization of said workpiece which passes through said space by use of said measuring means.

2. The workpiece measuring method according to claim 1, further comprising the steps of:

oscillating said workpiece in a radial direction of said surface plate while rotating it;

disposing a first sensor at a first location through which a central portion of said workpiece passes;

measuring the state of planarization of said workpiece near a central portion thereof by means of said first sensor;

disposing a second sensor in said space at a second location through which a peripheral portion of said workpiece passes; and measuring the state of planarization of said workpiece near the peripheral portion thereof by means of said second sensor.

3. The workpiece measuring method according to claim 1, further comprising the steps of:

oscillating said workpiece in a direction substaintially perpendicular to a radial direction of said surface plate while rotating the same;

disposing a single sensor in said space at a location through which a central portion of said workpiece passes; and measuring the state of planarization of said workpiece over a range from the central portion to a peripheral portion thereof by means of said single sensor.

4. A surface planarization apparatus comprising:

a rotatable surface plate;

a pressure member adapted to oscillate a workpiece in a radial direction of said surface plate while urging the workpiece against said surface plate; and a measuring device for measuring a state of planarization of the workpiece, wherein said surface plate is composed of a plurality of divided surface plate members which are all disposed in a concentric relation with respect to each other and rotatable independently each other, and said measuring device is disposed in a space between said divided surface plate members and at a location through which the workpiece passes.

5. The surface planarization apparatus having a measuring device according to claim 4, wherein:

a first measuring device for measuring a state of planarization of the workpiece near a central portion thereof is disposed within said space through which a central portion thereof is disposed within said space through which a central portion of the workpiece passes; and a second measuring device for measuring a state of planarization of the workpiece near a peripheral portion thereof is disposed within said space through which a peripheral portion of the workpiece passes.

* * * * *